US008732999B1

(12) United States Patent
Hughes

(10) Patent No.: US 8,732,999 B1
(45) Date of Patent: May 27, 2014

(54) METHOD AND APPARATUS FOR MOUNTING BANNER

(71) Applicant: Gerald W. Hughes, Foley, AL (US)

(72) Inventor: Gerald W. Hughes, Foley, AL (US)

( * ) Notice: Subject to any disclaimer, the term of this patent is extended or adjusted under 35 U.S.C. 154(b) by 0 days.

(21) Appl. No.: 14/100,935

(22) Filed: Dec. 9, 2013

(51) Int. Cl.
*G09F 17/00* (2006.01)
*G09F 15/00* (2006.01)

(52) U.S. Cl.
CPC ..... *G09F 17/00* (2013.01); *G09F 2015/0093* (2013.01)
USPC ..... 40/603; 160/329

(58) Field of Classification Search
CPC . G09F 15/0025; G09F 15/0018; G09F 17/00; G09F 2017/0041; G09F 2015/0093; G09F 2017/005; B29C 53/063
USPC ..... 40/603, 604, 606.13, 606.14, 606.18, 40/611.11, 624, 601; 160/329
See application file for complete search history.

(56) References Cited

U.S. PATENT DOCUMENTS 1,346,664 A * 7/1920 McMahon et al. ..... 160/329
2,960,784 A 11/1960 Frey et al.
3,537,201 A 11/1970 Huey et al.
3,609,894 A * 10/1971 Miller, III ..... 40/655
4,073,082 A * 2/1978 McWhorter ..... 40/591
4,829,688 A * 5/1989 Mouraret et al. ..... 40/622
4,866,866 A 9/1989 Rotter et al.
4,878,303 A 11/1989 Banniza et al.
5,407,178 A * 4/1995 Long ..... 256/45
5,463,973 A 11/1995 Tait
6,334,596 B1 * 1/2002 Temple ..... 248/156
6,718,669 B1 * 4/2004 Hayes ..... 40/610
7,213,356 B2 5/2007 Haggard, Jr.
8,327,565 B2 * 12/2012 Boltz et al. ..... 40/603
2009/0146029 A1 6/2009 Beatty
2010/0313493 A1 * 12/2010 Kamp ..... 52/105

* cited by examiner

*Primary Examiner* — Casandra Davis
(74) *Attorney, Agent, or Firm* — George L Williamson

(57) ABSTRACT

Method and apparatus for mounting a pair of banners between upright members wherein the banners includes a flexing mechanism so that the banners can withstand high wind situations. Upper, intermediate and lower collars are mounted onto the upright members so that the intermediate collar can slide up and down along the column to allow the banner to flex. Each collar has a pair of cylindrical receptacles for receiving horizontal members so that upper, intermediate and lower horizontal members are provided so that the intermediate horizontal member slides up and down along the members in high wind situations. Elastic members connecting the intermediate and lower horizontal members stretch in high wind situations to allow the banners to flex.

19 Claims, 3 Drawing Sheets

METHOD AND APPARATUS FOR MOUNTING BANNER

BACKGROUND OF THE INVENTION

1. Field of the Invention

The present invention relates generally to signs and, more particularly, is concerned with a system for mounting a flexible banner.

2. Description of the Related Art

Devices relevant to the present invention have been described in the related art, however, none of the related art devices disclose the unique features of the present invention.

In U.S. Patent Application Publication No. 2009/0146029 dated Jun. 11, 2009, Beatty disclosed a system, method and device for installation of banners. In U.S. Pat. No. 2,960,784 dated Nov. 22, 1960, Frey, et al., disclosed a horizontal banner mounting construction. In U.S. Pat. No. 5,463,973 dated Nov. 7, 1995, Tait disclosed a decorative banner mounting kit. In U.S. Pat. No. 3,537,201 dated Nov. 3, 1970, Huey, et al., disclosed a horizontal banner construction. In U.S. Pat. No. 4,878,303 dated Nov. 7, 1989, Banizza, et al. disclosed a sign. In U.S. Pat. No. 4,866,866 dated Sep. 19, 1989. Rotter, et al., disclosed a collapsible sign. In U.S. Pat. No. 7,213,356 dated May 8, 2007, Haggard, Jr., disclosed a banner display system.

While these devices may be suitable for the purposes for which they were designed, they would not be as suitable for the purposes of the present invention as hereinafter described.

SUMMARY OF THE PRESENT INVENTION

The present invention discloses a method and apparatus for mounting a pair of banner-type signs between upright columns so that the banner is attractively displayed and wherein the banner includes a flexing mechanism so that the banner can withstand high wind situations. Upper, intermediate and lower collars are mounted onto the upright columns so that the intermediate collar can slide up and down along the column to allow the banner to flex. Each collar has a pair of cylindrical receptacles mounted thereon through which a horizontal member can be inserted so that the horizontal member runs between the first and second columns. Thus, upper, intermediate and lower horizontal members are provided so that the intermediate horizontal member is allowed to slide up and down along the columns in high wind situations while the top collar and the lowest collar are fixedly secured to the columns. Elastic band members, such as rubber bands, connect the intermediate and lower horizontal members so that the elastic rubber bands stretch in high wind situations to allow the horizontal members to slide along the columns thereby allowing the banner to flex and thereby prevent tearing in high wind situations. The upright columns can be mounted in a concrete foundation or can be mounted onto a trailer so that the banner type sign can be moved about from one location to another.

An object of the present invention is to provide a mounting system for a banner wherein the banner can flex in a high wind situation to prevent the banner from being torn by high wind conditions. A further object of the present invention is to provide a mounting system for a banner which can be used on either new installations or existing installations wherein first and second columns are being used. A further object of the present invention is to provide a system for a banner which can be mounted on a conventional concrete foundation or on a movable trailer. A further object of the present invention is to provide a system for mounting a banner which can be easily used by an operator. A further object of the present invention is to provide a banner which can be relatively easily and inexpensively manufactured.

The present invention overcomes an inherent problem associated with conventional rigid banner frames which may be difficult to erect or store; may be unsightly and may not adapt to various size applications and support structures. Also, rigid sign frames can allow the wind to damage the material of which the banner is constructed which may cause distortion of the banner image in the absence of a flexing member.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
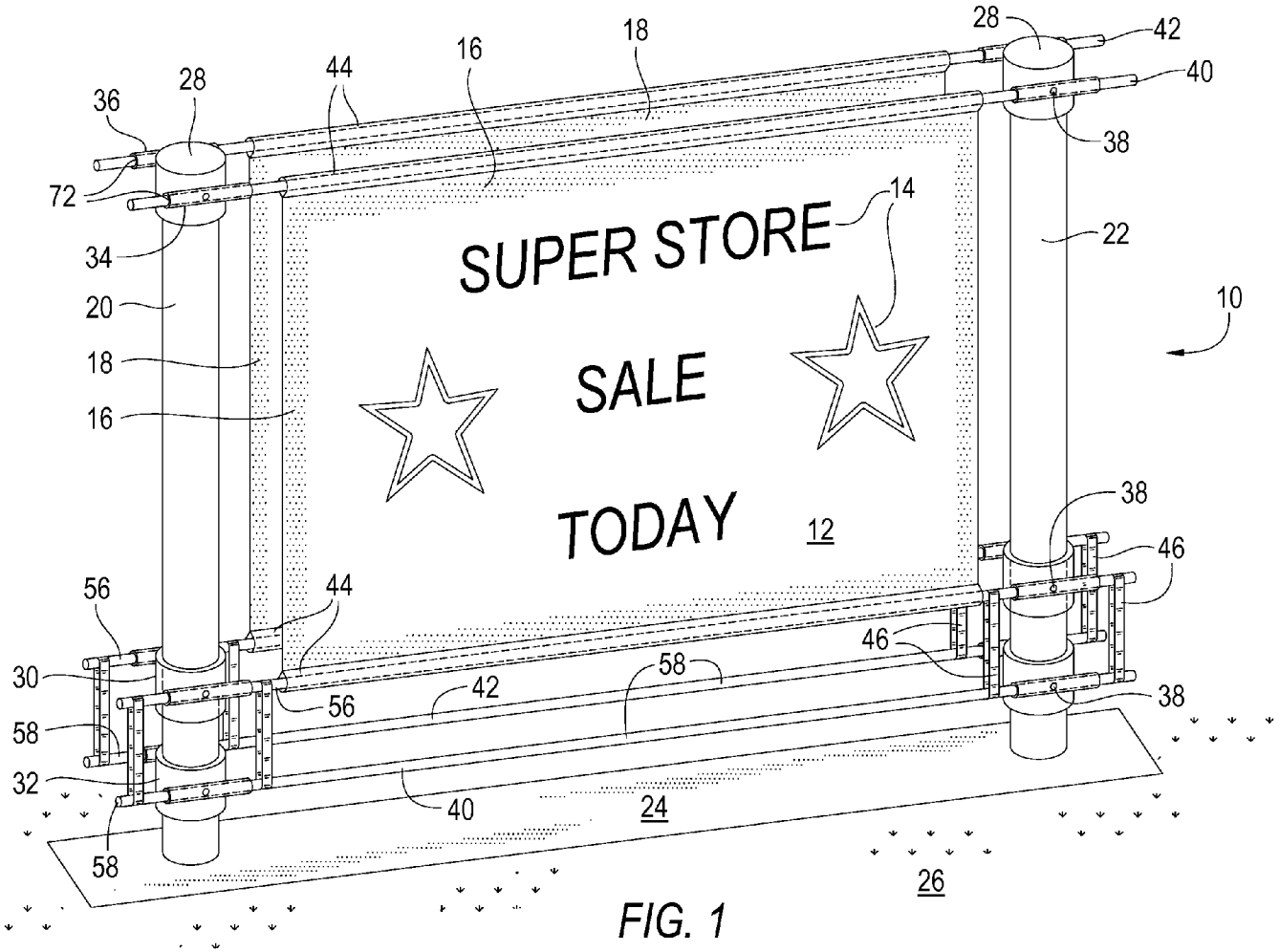
FIG. 1 is a perspective view of the present invention shown in operative connection.
Figure 2:
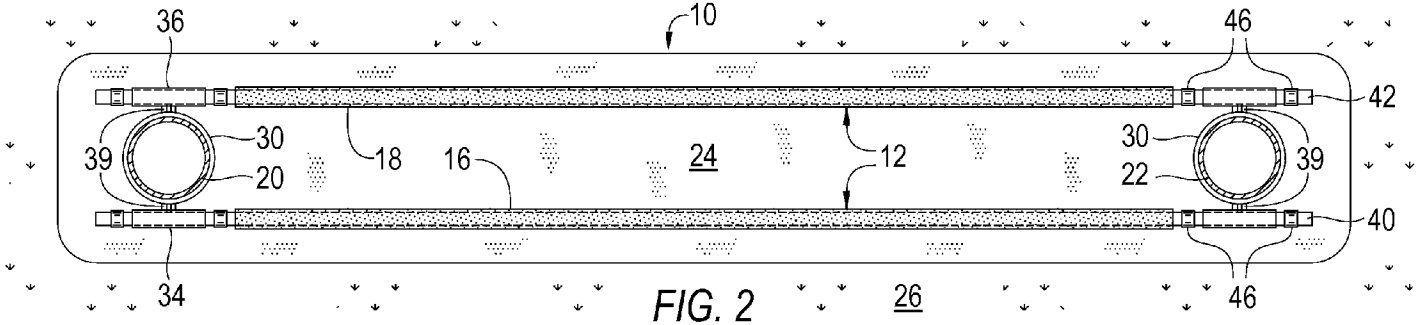
FIG. 2 is a cross-section view of the present invention taken from FIG. 3 as indicated.

With regard to reference numerals used, the following numbering is used throughout the drawings.

10 present invention
12 flexible sign/banner
14 logo/advertisement
16 front banner
18 rear banner
20 left column/upright member
22 right column/upright member
24 foundation
26 ground
28 top collar
30 intermediate collar
32 bottom collar
34 front cylindrical receptacle
36 rear cylindrical receptacle
38 fastener means
39 fastener means
40 front horizontal member

42 rear horizontal member
44 sleeve/pole pocket
46 elastic band
48 first half
50 second half
52 fastener
54 bungee cord
56 intermediate horizontal member
58 bottom horizontal member
60 trailer
62 platform
64 wheels
66 axle
68 stabilizer
70 attachment
72 bore
74 direction arrow
76 attachment point/grommet
78 attachment point

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 9 illustrate the present invention wherein a system for mounting a flexible banner type sign is disclosed and which is generally indicated by reference number 10.

Turning to FIGS. 1 through 4, therein is shown the present invention 10 having a flexible sign or banner 12 displaying a logo or advertisement 14 thereon wherein there is a front banner 16 and a rear banner 18 disposed between upright spaced apart left column 20 and right column 22 which columns are disposed in a conventional foundation 24, e.g., concrete, which is disposed in the ground 26, Shown on the columns 20, 22 are an upper or top collar 28 having an optional cap thereon, an in-between or intermediate collar 30, and a lower or bottom collar 32 wherein each collar has a front cylindrical receptacle 34 and a tear cylindrical receptacle 36 wherein each receptacle has a fastener means or weld 38 for securing a corresponding horizontal member 40, 42, and a fastener 39 for attachment to each collar 28, 30, 32, and a bore 72 therein through which the horizontal member can be slidingly disposed. The cylindrical receptacles 34, 36, respectively, receive a front and rear horizontal member 40, 42 wherein each horizontal member is disposed in a pole pocket or sleeve 44 extending along the upper and lower edges of the sign or banner 12 and extending from one end to the other end of the banner so that the banner is secured to the corresponding horizontal member. Elastic bands 46, or the like, are placed on near the ends of the intermediate and bottom horizontal members 56, 58 so as to allow the intermediate collar 30 to slide up or down the columns in high wind conditions, as shown by direction arrows 74, which thereby allows the sign/banner 12 to flex in high wind conditions. The upper/top collar 28 and lower/bottom collar 32 are fixedly attached to the left and right columns 20, 22 whereas the intermediate collar 30 is slidably attached to the columns so that the intermediate collar 30 can slide up and down the columns 20, 22. The elastic bands 46 bias the intermediate horizontal member 56 downwardly so as to cause the flexible sign/banner 12 to be effectively tensioned between the top horizontal member and the intermediate horizontal member. For definition purposes, the term "intermediate" as used in this application does not mean "middle" or "mid-point", and, it should be clear from FIG. 1 that the intermediate horizontal members and collars are between but closer to the lower rather than the upper horizontal members and collars.

Figure 5:
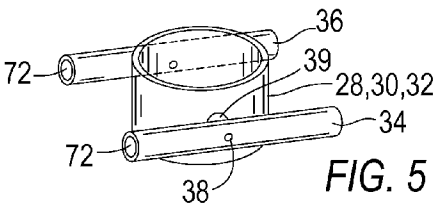
FIGS. 5 through 7 are perspective views of alternative embodiments of the collar of the present invention.
Figure 6:
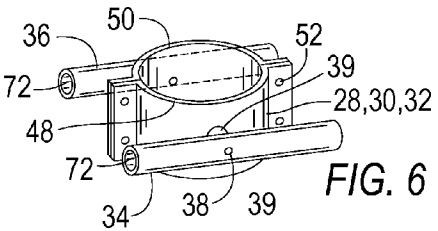
Figure 7:
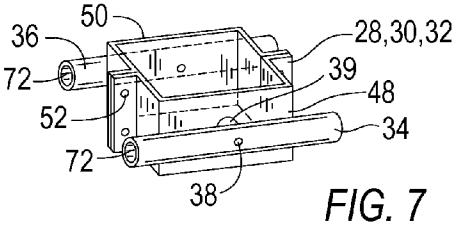
Figure 4:
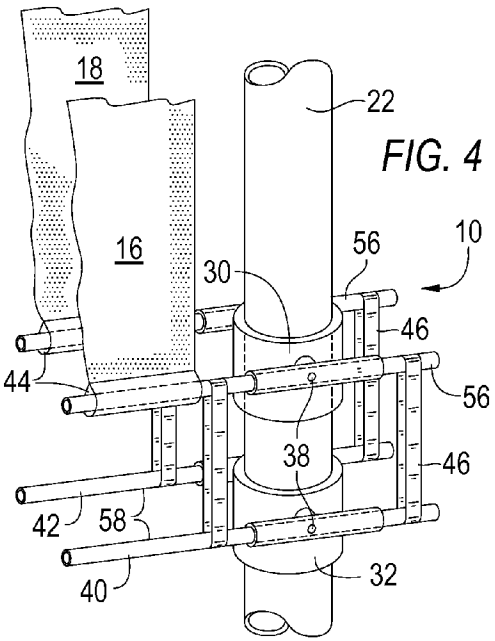
FIG. 4 is a perspective view showing cutaway portions of the present invention.
Figure 3:
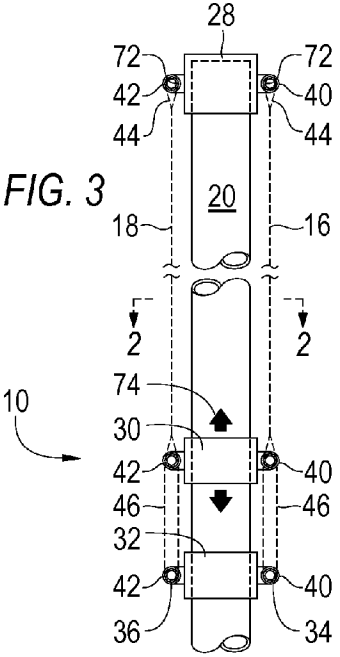
FIG. 3 is a side elevation view of the present invention.

Turning to FIGS. 5 through 7, therein are shown alternative embodiments of the collars 28, 30, 32 wherein FIG. 5 shows a round collar constructed of a single piece; FIG. 6 shows a round collar 28, 30, 32 having a first half 48 and a second half 50 which are joined together by fastener 52; and, FIG. 7 shows a square or rectangular collar 28, 30, 32 having first and second halves 48, 50 joined by fastener 52 so that square collars can be used in the event square columns are being used. Each of the collars shown in FIGS. 5 through 7 have a front and rear 34, 36 cylindrical receptacle thereon being attached to the collars by an attachment or fastener means 39, e.g., a weld, nut and bolt, screw, or the like, wherein each receptacle has a bore 72 therein for receiving a horizontal member 40, 42 therein. Also shown are an attachment or fastener means 38, e.g., a weld, nut and bolt, screw, or the like, for securing the horizontal members inside the corresponding cylindrical receptacles.

Figure 8:
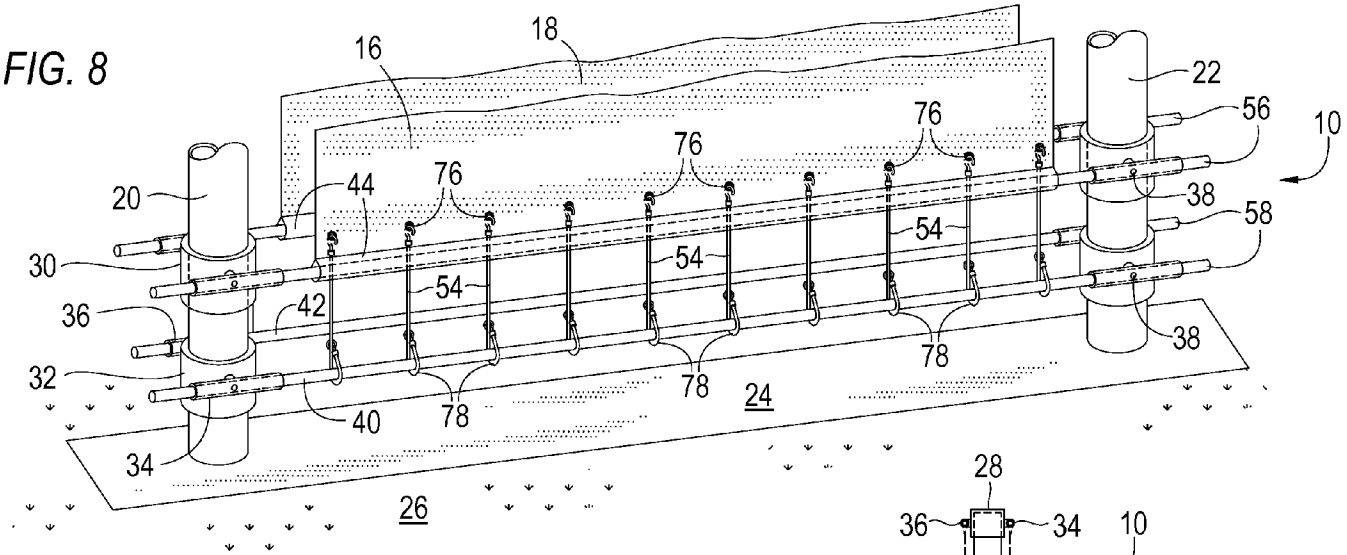
FIG. 8 is a perspective view of an alternative embodiment of the present invention.

Turning to FIG. 8, therein is shown second embodiment of the present invention which uses a plurality of bungee cords 54 stretched between the bottom horizontal member 58 at 78 and the intermediate horizontal member 56 (the cords 54 may also be attached directly to the banner at 76 using a grommet or the like) instead of using the elastic bands 46 as previously disclosed. In all respects, the bungee cords 54 act in the same manner as the previously disclosed elastic bands 46 so that the flexible sign/banner 12 is allowed to flex up or down by allowing the collar 30 to slide up and down the left and right columns 20, 22.

Figure 9:
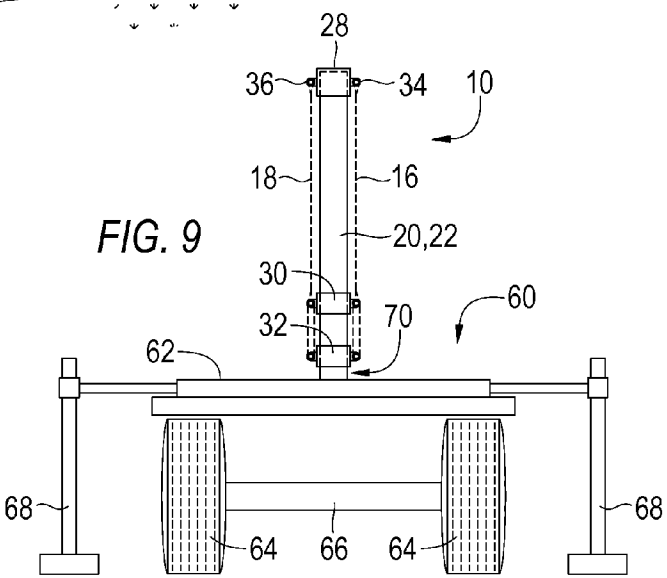
FIG. 9 is a side elevation view of the present invention mounted onto a trailer.

Turning to FIG. 9, therein is shown the present invention 10 mounted on a conventional trailer 60 or a truck bed wherein the trailer or truck bed has a movable platform 62 for receiving the columns 20, 22 wherein the columns are suitably attached at 70, e.g., by welding or nuts and bolts, so that the columns are secured to the trailer 60. Also shown are wheels 64, axle 66, left and right stabilizers 68 wherein the trailer would be constructed and positioned in the conventional manner as would be done in the standard manner by one skilled in the art.

The present invention 10 discloses a system of components, which assemble into a structurally sound, architecturally appealing sign frame system which includes a flexible member which can be mounted to assorted surfaces allowing for portability or permanent positioning. When erected, the present invention 10 offers vertical support for printed messages on two sides and it can be collapsed for either storage or transportation.

The present invention 10 may be constructed of aluminum or steel materials, in round or rectangular form, with varying dimensions and metal strengths to support various size applications and is adaptable to support small and large messages. Elastic resistance bands 46, 54, or the like, expand and retract in the wind providing shock absorbing elasticity that allows the banner 12 to flex with the wind thereby offsetting damages to the message medium material and also maintains a preferred tight appearance to the sign face. The present invention 10 offers ease of assembly and the structural strength required for message support.

In summary, and by reference to FIGS. 1-9, the present invention 10 may be described as a method for mounting a banner 12 as follows: a) providing first and second spaced apart upright members 20, 22, each having a front and rear side; b) providing a first and second banner 16,18 each having an upper and a lower edge and a left and right side, wherein the first and second banners are disposed between the first and second upright members; c) providing upper 28, lower 32, and intermediate 30 collars on each upright member, wherein the upper and lower collars are fixedly attached to each upright member, wherein the intermediate collar is slidably attached to each upright member, wherein each collar has a front and rear side corresponding to the front and rear side of the upright members; d) providing a first and second substantially horizontal member 40, 42 on each said collar, wherein each horizontal member has left and right ends, wherein a first horizontal member is disposed on the front side of each collar and a second horizontal member is disposed on the rear side of each collar so that an upper, lower and intermediate horizontal member corresponds to each upper, lower and intermediate collar; e) disposing an upper edge (similarly located as 44) of the first banner on the first upper horizontal member and a lower edge (similarly located as 44) of the first banner on the first intermediate horizontal member, and disposing an upper edge of the second banner on the second upper horizontal member and a lower edge of the second banner on the second intermediate horizontal member so that one of the banners can always be viewed by an observer positioned on either the front or rear side of the upright member; and, f) providing a plurality of first elastic members 46 configured for resilient engagement with the first intermediate horizontal member and the first lower horizontal member for absorbing shock, and providing a plurality of second elastic members configured for resilient engagement with the second intermediate horizontal member and the second lower horizontal member for absorbing shock, thereby forming a structure providing flexibility to the first and second banner contributing to structural strength resistant to forces produced by high wind conditions. Further, providing a pole pocket 44 on the upper and lower edge of each banner, wherein each pole pocket extends from the left side to the right side of the banner for receiving a horizontal member therein. Further, providing a cylindrical receptacle 34, 36 on the front and rear side of each collar, the cylindrical receptacle for receiving an end of the first or second horizontal member to permit the horizontal member to be mounted to the collars. Further, also slidable inserting a horizontal member into each corresponding cylindrical receptacle and then into each corresponding pole pocket. Wherein the elastic members comprise a plurality of resistance bands 46 or wherein the elastic members comprise a plurality of bungee cords 46. Further, supporting the first and second upright members in a concrete foundation 24 disposed in the ground 26. Further, mounting the first and second upright members on a movable platform 62 for being moved from one location to another. Also, wherein each upright member and collar is round shaped (FIG. 5) or rectangular shaped (FIG. 7). Also, wherein a portion of the first and second elastic members 54 directly engage a portion 76 of the corresponding first and second banner.

What is claimed to be new and desired to be protected by Letters Patent is set forth in the appended claims:

1. A system for mounting a banner, comprising:

a) a first and second upright member, wherein said first and second upright members are spaced apart and each has a front and rear side;

b) a first and second banner, said first and second banner having an upper and a lower edge and a left and right side, wherein said first and second banners are disposed between said first and second upright members;

c) upper, lower, and intermediate collars disposed on each upright member, wherein said upper and lower collars are fixedly attached to each said upright member, wherein said intermediate collar is slidably attached to each said upright member, wherein each said collar has a front and rear side corresponding to said from and rear side of said upright members;

d) a first and second substantially horizontal member being disposed on each said collar, wherein each horizontal member has left and right ends, wherein a first said horizontal member is disposed on said front side of each said collar and a second said horizontal member is disposed on said rear side of each said collar;

e) wherein an upper edge of said first banner is disposed on said first horizontal member on said upper collar and a lower edge of said first banner is disposed on said first horizontal member on said intermediate collar, and, an upper edge of said second banner is disposed on said second horizontal member on said upper collar and a lower edge of said second banner is disposed on said second horizontal member on said intermediate collar so that one of the banners can always be viewed by an observer positioned on either the front or rear side of the upright member; and, f) a plurality of first elastic members configured for resilient engagement with said first horizontal member on said intermediate collar and said first horizontal member on said lower collar for absorbing shock, and a plurality of second elastic members configured for resilient engagement with said second horizontal member on said intermediate collar and said second horizontal member on said lower collar for absorbing shock, whereby said system forms a structure providing flexibility to said first and second banner contributing to structural strength resistant to forces produced by high wind conditions.

2. The system of claim 1, further comprising a pole pocket being disposed on said upper and lower edge of each said banner, wherein each said pole pocket extends from said left side to said right side of said banner for receiving one of said horizontal members therein.

3. The system of claim 2, further comprising a cylindrical receptacle disposed on said front and rear side of each said collar, said cylindrical receptacle for receiving an end of said first or second horizontal member to permit the horizontal member to be mounted to the collars.

4. The system of claim 3, wherein one of said horizontal members can be slidably inserted into said cylindrical receptacle and then into said pole pocket.

5. The system of claim 1, wherein said elastic members comprises a plurality of resistance bands.

6. The system of claim 1, wherein said elastic members comprises a plurality of bungee cords.

7. The system of claim 1, wherein said first and second upright members are supported by a concrete foundation disposed in the ground.

8. The system of claim 1, wherein said first and second upright members are mounted on a movable platform for being moved from one location to another.

9. A method for mounting a banner, comprising the steps of:

a) providing first and second spaced apart upright members, each having a front and rear side;

b) providing a first and second banner each having an upper and a lower edge and a left and right side, wherein the first and second banners are disposed between the first and second upright members;

c) providing upper, lower, and intermediate collars on each upright member, wherein the upper and lower collars are fixedly attached to each upright member, wherein the intermediate collar is slidably attached to each upright member, wherein each collar has a front and rear side corresponding to the front and rear side of the upright members;

d) providing a first and second substantially horizontal member on each said collar, wherein each horizontal member has left and right ends, wherein a first horizontal member is disposed on the front side of each collar and a second horizontal member is disposed on the rear side of each collar so that an upper, lower and intermediate horizontal member corresponds to each upper, lower and intermediate collar;

e) disposing an upper edge of the first banner on the first horizontal member on said upper collar and a lower edge of the first banner on the first horizontal member on the intermediate collar, and disposing an upper edge of the second banner on the second upper horizontal member on the upper collar and a lower edge of the second banner on the second horizontal member on the intermediate collar so that one of the banners can always be viewed by an observer positioned on either the front or rear side of the upright member; and, f) providing a plurality of first elastic members configured for resilient engagement with the first horizontal member on said intermediate collar and the first horizontal member on the lower collar for absorbing shock, and providing a plurality of second elastic members configured for resilient engagement with the second horizontal member on the intermediate collar and the second horizontal member on the lower collar for absorbing shock, thereby forming a structure providing flexibility to the first and second banner contributing to structural strength resistant to forces produced by high wind conditions.

10. The method of claim 9, further comprising the step of providing a pole pocket on the upper and lower edge of each banner, wherein each pole pocket extends from the left side to the right side of the banner for receiving one of said horizontal members therein.

11. The method of claim 10, further comprising the step of providing a cylindrical receptacle on the front and rear side of each collar, the cylindrical receptacle for receiving an end of the first or second horizontal member to permit the horizontal member to be mounted to the collars.

12. The method of claim 11, further comprising the step of slidable inserting one of said horizontal members into each corresponding cylindrical receptacle and then into each corresponding pole pocket.

13. The method of claim 9, wherein the elastic members comprise a plurality of resistance bands.

14. The method of claim 9, wherein the elastic members comprise a plurality of bungee cords.

15. The method of claim 9, further comprising the step of supporting the first and second upright members in a concrete foundation disposed in the ground.

16. The method of claim 9, further comprising the step of mounting the first and second upright members on a movable platform for being moved from one location to another.

17. The method of claim 9, wherein each upright member and collar is round shaped.

18. The method of claim 9, wherein each upright member and collar is rectangular shaped.

19. The method of claim 9, wherein a portion of the first and second elastic members directly engage a portion of the corresponding first and second banner.

* * * * *